US008073175B2

(12) United States Patent
Watanuki

(10) Patent No.: US 8,073,175 B2
(45) Date of Patent: Dec. 6, 2011

(54) BEHIND-THE-EAR TYPE HEARING AID

(75) Inventor: Keisuke Watanuki, Tokyo (JP)

(73) Assignee: Rion Co., Ltd., Tokyo (JP)

( * ) Notice: Subject to any disclaimer, the term of this patent is extended or adjusted under 35 U.S.C. 154(b) by 1199 days.

(21) Appl. No.: 11/788,760

(22) Filed: Apr. 20, 2007

(65) Prior Publication Data

US 2008/0025541 A1 Jan. 31, 2008

(30) Foreign Application Priority Data

Apr. 20, 2006 (JP) ..... 2006-116617
Apr. 18, 2007 (JP) ..... 2007-108769

(51) Int. Cl.
*H04R 25/00* (2006.01)

(52) U.S. Cl. ..... 381/330; 381/381

(58) Field of Classification Search ..... 381/312, 381/328, 330, 370, 374, 380–383; 379/430; 455/575.2

See application file for complete search history.

(56) References Cited

U.S. PATENT DOCUMENTS

2005/0190939 A1* 9/2005 Fretz ..... 381/330

* cited by examiner

*Primary Examiner* — Tuan Nguyen

(74) *Attorney, Agent, or Firm* — Carrier Blackman & Associates, P.C.; Joseph P. Carrier; William D. Blackman

(57) ABSTRACT

A behind-the-ear type hearing aid which can improve a fit to a user includes a hearing aid main body and a tube for introducing sound output from the hearing aid main body to an external auditory meatus. The tube is comprised of a connector portion, and a tube portion having one end which connects to the connector portion and an opposite end which to an earplug. The tube portion is constructed so as to be freely transformed, into a desired shape and a metal wire for maintaining the transformed shape is embedded in the tube portion. Also, the shape of the hearing aid main body to be in contact with a user's body can be formed corresponding to the shape of a user's body.

6 Claims, 4 Drawing Sheets

BEHIND-THE-EAR TYPE HEARING AID

CROSS-REFERENCE TO RELATED APPLICATIONS

The present application is a U.S. National phase of, and claims priority based on Japanese patent application 2006-116617, filed 20 Apr. 2006, and Japanese patent application 2007-108769, filed 18 Apr. 2007. The entire disclosure of each of the referenced priority documents is incorporated herein by reference.

BACKGROUND OF THE INVENTION

1. Field of the Invention

The present invention relates to a behind-the-ear type hearing aid provided with a tube for introducing sound output from a main body of the hearing aid to an external auditory meatus.

2. Description of the Related Art

In a conventional behind-the-ear type hearing aid, see FIG. 9 a hook 101 is attached to a main body of the hearing aid 100. The entire hearing aid is retained by an auricle by hanging the hook 101 on the auricle. The hook 101 is connected to an earplug 103 by interposing a tube 102 therebetween. The hook 101, the tube 102 and the earplug 103 serve to transmit sound which is output from an earphone within the hearing aid main body 100 to an external auditory meatus. Typically, the hook 101 has a few kinds of sizes including a large size, a middle size, and a small size. A user selects a suitable one depending on the shape or the size of the user's ear. Although various designs are possible with respect to the outer appearance of the hearing aid main body 100, a conventional one substantially has a banana shape.

However, since a user has to select one from only about three kinds of hooks, the selected one is not always suitable to the shape of the user's ear. On the other hand, it is not practical to prepare many kinds of hooks. In addition, since there are various different ear shapes, there are cases where a good fit cannot be achieved even if the shape of the hook is adjusted based on a merely geometric shape. Also, since the outer appearance of the hearing aid main body 100 is ready-made, there are cases where the hearing aid does not fit into the back side of the auricle so as to become unstable.

The present invention was made to solve the above-described problems of the conventional art, and the object of the present invention is to provide a behind-the-ear type hearing aid which can improve a fit to a user.

SUMMARY OF THE INVENTION

In order to solve the above-described problems, according to the first aspect of the present invention, a behind-the-ear type hearing aid includes a hearing aid main body and a tube for introducing sound output from the hearing aid main body to an external auditory meatus, in which a metallic member is provided along an outer wall, an inner wall or inside the wall of the tube.

According to the second aspect of the present invention, a behind-the-ear type hearing aid includes a hearing aid main body and a tube for introducing sound output from the hearing aid main body to an external auditory meatus, in which the tube can be transformed freely into a desired shape and the transformed shape can be maintained.

According to the third aspect of the present invention, a behind-the-ear type hearing aid includes a hearing aid main body, and an earplug which is provided with an earphone, in which a connecting member for connecting the earplug and the hearing aid main body can be transformed freely into a desired shape and the transformed shape can be maintained.

According to the fourth aspect of the present invention, in the hearing aid of the first through the third aspects, the hearing aid main body contacts a portion of a user's body when the hearing aid is worn by the user, and a shape of the hearing aid main body to be in contact with a user's body is formed corresponding to a shape of the portion of the user's body.

In the first aspect of the present invention, the metallic member can be manipulated to transform the tube into a desired shape and maintain the desired shape. Therefore, it is possible to improve a fit to a user by transforming the tube.

In the second aspect of the present invention, since the tube can be transformed into a desired shape and the shape can be maintained, it is possible to improve a fit to a user by transforming the tube corresponding to the user.

In the third aspect of the present invention, since the connecting member for connecting the earplug and the hearing aid main body can be transformed into a desired shape and the shape can be maintained, it is possible to improve a fit to a user by transforming the tube corresponding to the user.

In the fourth aspect of the present invention, since the shape of the hearing aid main body to be in contact with a user's body can be formed corresponding to the user's body and the shape can be maintained, it is possible to improve the fit to the user and the stability of wearing.

DETAILED DESCRIPTION OF THE PREFERRED EMBODIMENTS

Figure 1:
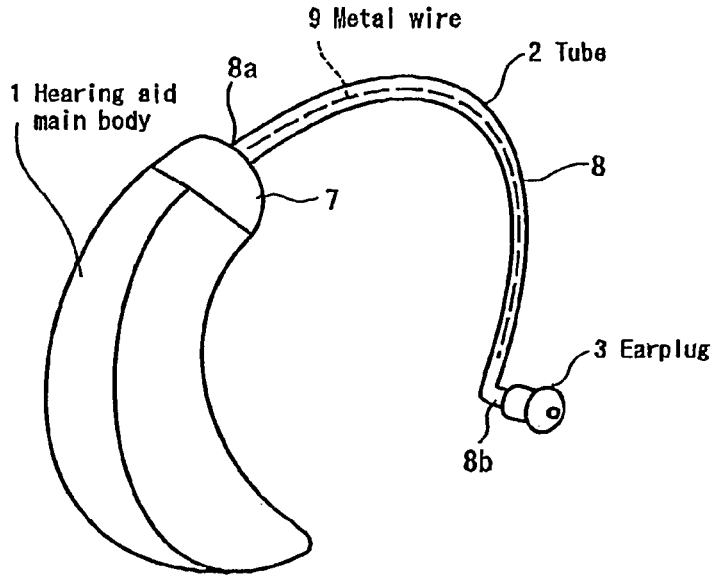
FIG. 1 is a schematic view showing a first embodiment of a behind-the-ear type hearing aid according to the present invention.
Figure 4:
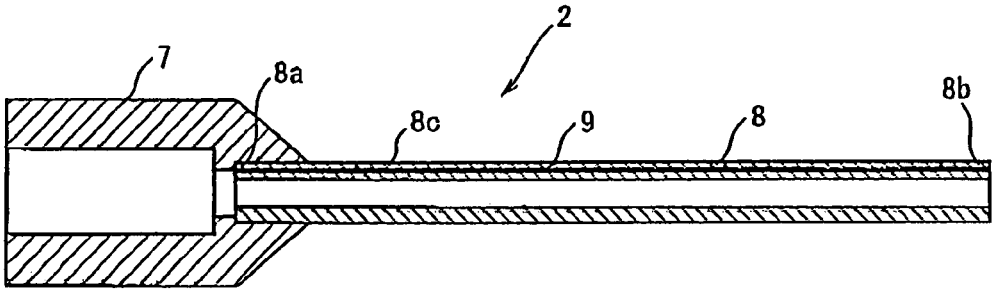
FIG. 4(*a*) is a cross-sectional view of the tube and FIG. 4(*b*) is a front view of the tube.
Figure 4:
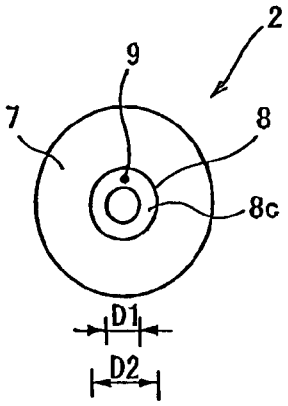
Figure 5:
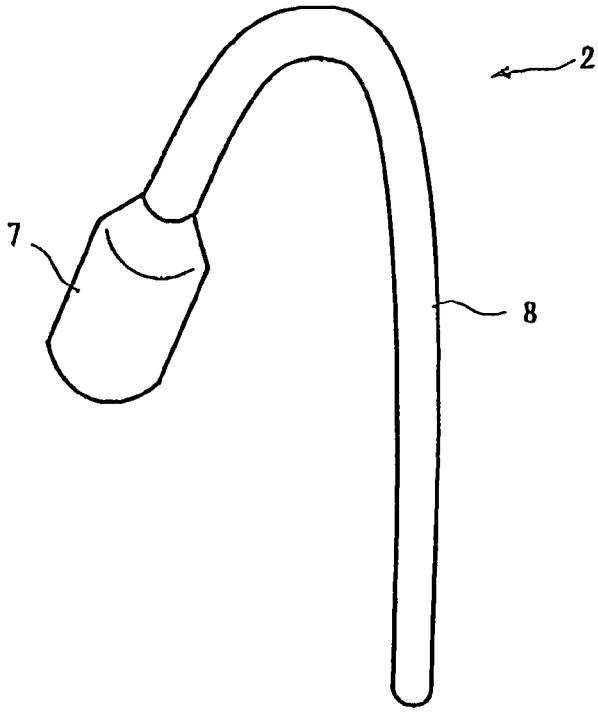
FIG. 5 is a perspective view of the tube transformed substantially corresponding to the shape of an auricle.
Figure 6:
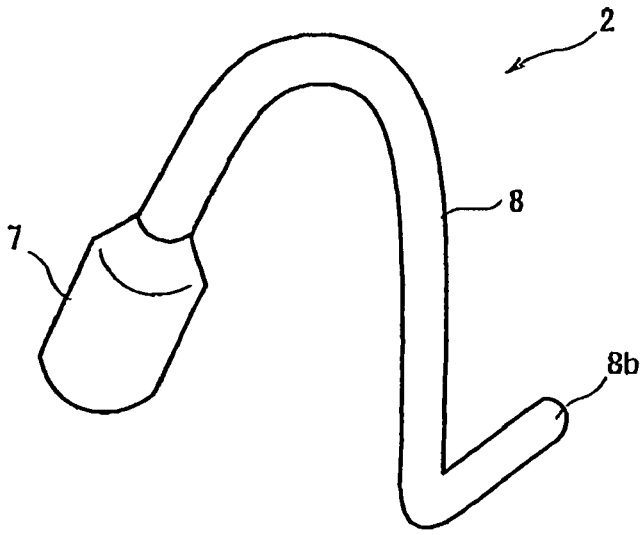
FIG. 6 is a perspective view of the tube transformed substantially corresponding to the shape of an auricle.
Figure 7:
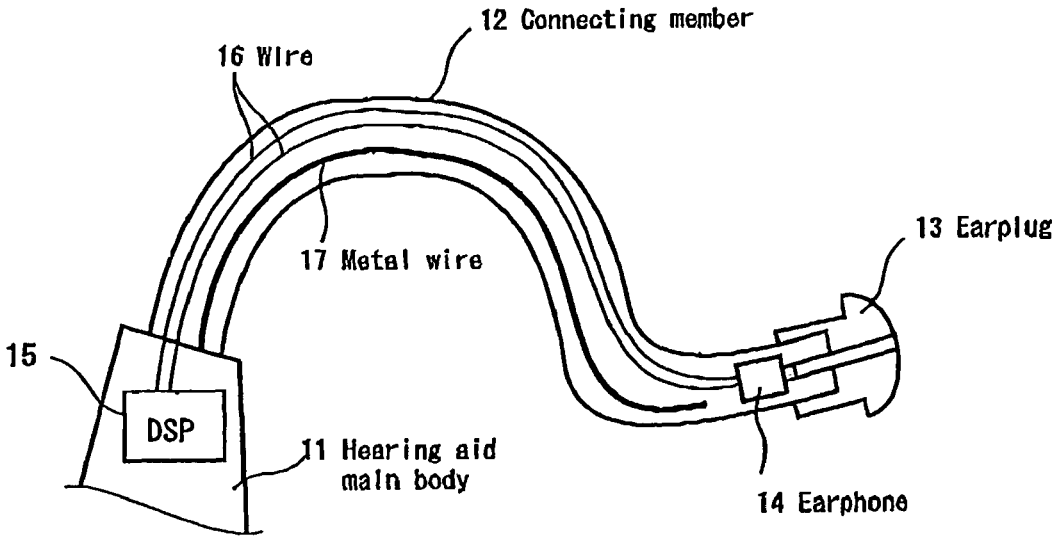
FIG. 7 is a schematic view showing a second embodiment of a behind-the-ear type hearing aid according to the present invention.
Figure 8:
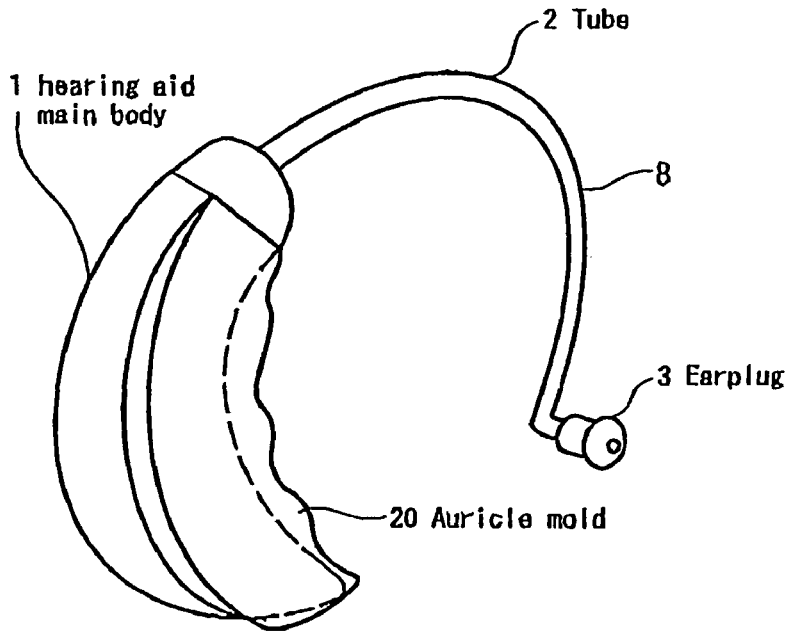
FIG. 8 is a schematic view showing a third embodiment of a behind-the-ear type hearing aid according to the present invention.
Figure 9:
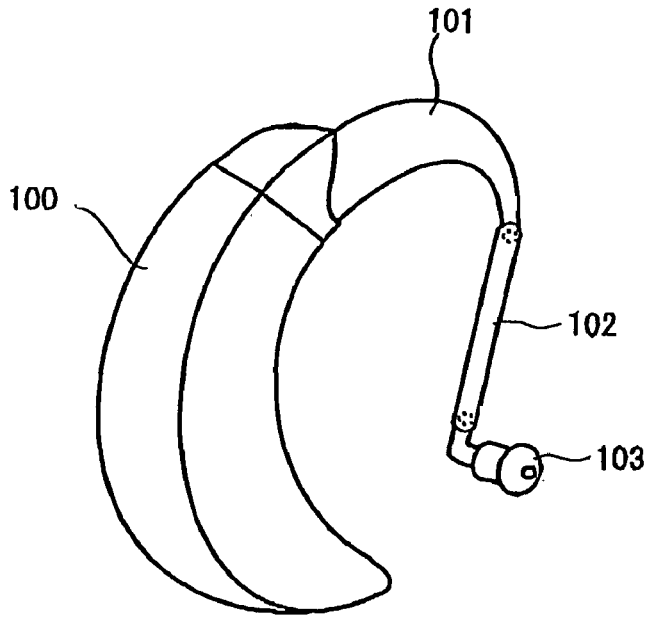
FIG. 9 PRIOR ART
FIG. 9 is a perspective view of a behind-the-ear type hearing aid according to a conventional art.

Embodiments of the present invention will now be explained hereinafter with reference to the accompanying drawings. FIG. 1 is a schematic view showing a first embodiment of a behind-the-ear type hearing aid according to the present invention, FIGS. 2(*a*)-(*c*) are schematic views of an attaching end surface of the hearing aid main body and the earphone sound port, FIG. 3 is a perspective view of a tube used in the first embodiment, FIG. 4(*a*) is a cross-sectional view of the tube and FIG. 4(*b*) is a front view of the tube, FIG. 5 and FIG. 6 are a perspective view of the tube transformed substantially corresponding to the shape of an auricle, FIG. 7 is a schematic view showing a second embodiment of a behind-the-ear type hearing aid according to the present invention, and FIG. 8 is a schematic view showing a third embodiment of a behind-the-ear type hearing aid according to the present invention.

Figure 2:
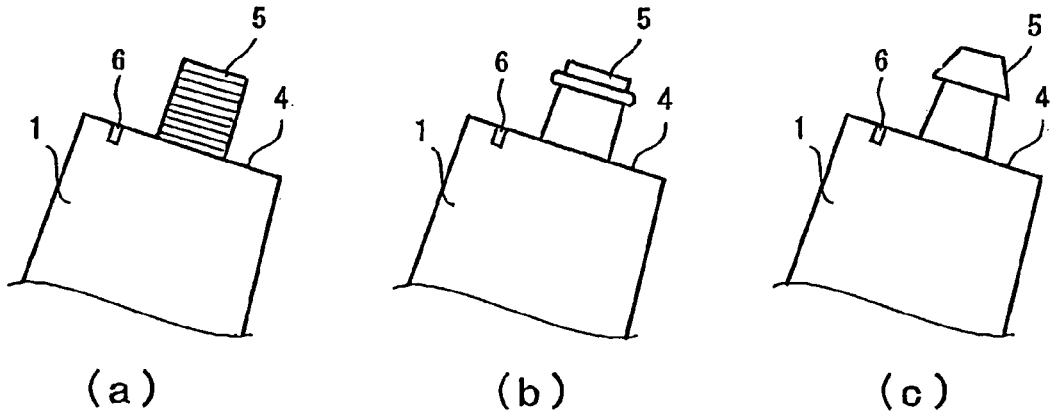
FIGS. 2(*a*)-(*c*) are schematic views of an attaching end surface of the hearing aid main body and the earphone sound port, in which FIG. 2(*a*) shows a case where an external thread is formed in the outer peripheral surface, FIG. 2(*b*) shows a case where a snap is provided in the outer peripheral surface, and FIG. 2(*c*) shows a case where an inverse sheath is provided at the tip end.

As shown in FIG. 1, according to the first embodiment of the present invention, the behind-the-ear type hearing aid has a hearing aid main body 1, a tube 2, and an earplug 3. As shown in FIG. 2, an earphone sound port 5 and a microphone sound port 6 are provided in an attaching end surface 4 of the hearing aid main body 1 for attaching the tube 2. Examples of the earphone sound port 5 include a substantially cylindrical projection made of metal having an external thread on the outer periphery thereof as shown in FIG. 2(*a*), a substantially cylindrical projection made of metal having a snap on the outer periphery thereof as shown in FIG. 2(*b*), and a substantially cylindrical projection made of metal having an inverse-sheath shape at the tip end thereof as shown in FIG. 2(*c*). Alternatively, the microphone sound port 6 may be provided in the side surface of the hearing aid main body instead of the attaching end surface 4.

Figure 3:
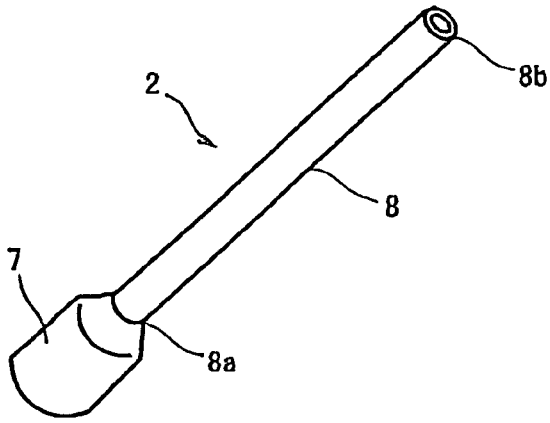
FIG. 3 is a perspective view of a tube used in the first embodiment.

As shown in FIGS. 1 and 3, the tube 2 is comprised of a connector portion 7 made of resin which is engaged with the earphone sound port 5 so as to be contacted with the attaching end surface 4, and a tube portion 8 which connects an end 8*a* to the connector portion 7 and connects the other end 8*b* to the earplug 3. The tube portion 8 has a wall portion 8*c* in which a metal wire 9 having a string shape is embedded in a longitudinal direction as shown in FIG. 4. The metal wire 9 may be fixed to the outer wall or inner wall of the tube portion 8 with an adhesive. However, in terms of the fitness and the acoustic effect, it is preferable to embed the metal wire 9 in the wall.

The tube portion 8 is made of soft resin such as silicon or elastomer. The inside diameter D1 of the tube portion 8 is around 1-2 mm, and the outside diameter D2 of the tube portion 8 is around 1.5-2.5 mm. The metal wire 9 is made of a metallic material such as stainless steel, copper, or tungsten having a string shape. The diameter of the metal wire 9 is preferably around 0.1-0.2 mm, so that the shape can be transformed into a desired one by hand and the transformed shape can be maintained. The tube 2 is formed by insert molding. It is also possible to form the connector portion 7 and the tube portion 8 as one part.

The tube 2 can be applied to a behind-the-ear type hearing aid provided with a hook.

Next, explanations will be made on the operation and the fitting method of the behind-the-ear type hearing aid according to the first embodiment. The connector portion 7 of the tube 2 is screwed into the earphone sound port 5 of the hearing aid main body 1. As shown in FIG. 5, the tube portion 8 is bent so as to approximately correspond to the shape of the user's auricle in advance. The tube portion 8 can be bent easily by hand, and the bent shape of the tube portion 8 can be maintained after being released from the hand.

Next, the hearing aid main body 1 is fit behind the auricle, and the bent shape of the tube portion 8 is fine-tuned so as to correspond to the shape of the auricle. The end 8*b* of the tube portion 8 is bent toward the inside of the external auditory meatus as shown in FIG. 6, and the end 8*b* is cut so that the length of the tube portion 8 is adjusted to an appropriate one. Next, the earplug 3 is attached to the end 8*b* of the tube portion 8. The end 8*b* of the tube portion 8 may be cut so as to locate the end 8*b* of the tube portion 8 inside the external auditory meatus without attaching the earplug 3.

In this way, the tube 2 can be bent easily by hand and the bent shape can be maintained, which makes it possible to change the shape of the tube 2 into a desired one. Further, the shape of the tube 2 can be fine-tuned so as to correspond to the shape of a user's auricle, which makes it possible to achieve a stable good fit.

According to the second embodiment of the present invention, the behind-the-ear type hearing aid has a hearing aid main body 11, a connecting member 12 made of resin, and an earplug 13 in which an earphone 14 is installed as shown in FIG. 7. One end of the connecting member 12 is connected to the hearing aid main body 11, and the other end is connected to the earplug 13.

Two wires 16 are embedded in the connecting member 12 so as to electrically connect an electric circuit (DSP: digital signal processor) 15 installed in the connecting member 12 and the earphone 14, and a metal wire 17 having a string shape is also embedded in a longitudinal direction of the connecting member 12 so that the shape of the connecting member 12 can be changed into a desired one and the shape can be maintained. The connecting member 12 is made of resin such as silicon or elastomer. The metal wire 17 is made of a material such as stainless steel, copper, or tungsten, and preferably the diameter thereof is around 0.1-0.2 mm.

Next, explanations will be made on the operation and the fitting method of the behind-the-ear type hearing aid according to the second embodiment. The connecting member 12 is bent so as to approximately correspond to the shape of the user's auricle in advance. The connecting member 12 can be bent easily by hand, and the bent shape of the connecting member 12 can be maintained after being released from the hand.

Next, the hearing aid main body 1 is fit behind the auricle, and the bent shape of the connecting member 12 is fine-tuned so as to correspond to the shape of the auricle. The connecting member 12 is bent so as to direct the earplug 13 toward the inside of the external auditory meatus.

In this way, the connecting member 12 can be bent easily by hand and the bent shape can be maintained, which makes it possible to change the shape of the connecting member 12 into a desired one. Further, the shape of the connecting member 12 can be fine-tuned so as to correspond to the shape of a user's auricle, which makes it possible to achieve a stable good fit.

Incidentally, in the above-described embodiments, a single metal wire 9 or 17 is provided in the tube 2 or in the connecting member 12. However, the number of the metal wire 9 or 17 is not limited to one, and a plurality of metal wires are possible as far as a user can easily bend the tube 2 or the connecting member into a desired shape. Further, the shape of the metal wire 9 or 17 is not limited to a string shape, and a linear shape, a spiral shape or a mesh shape is also possible.

Also, the tube itself may have a shape memory property without using a metallic member such as a metal wire. In a case of using a shape memory resin having a property of being softened by irradiation with light of a predetermined wavelength, it is possible to freely change the shape of the tube by bending the tube while being irradiated with light of the predetermined wavelength, and maintain the shape with certain elasticity when irradiation is stopped. It is also possible to use a shape memory resin having such a property that the bent state can be adjusted by the intensity of light or the time of irradiation. Furthermore, when a resin having such a property that the elasticity can be increased with temperature such as body temperature, it is possible to improve the fit.

As shown in FIG. 8, in the behind-the-ear type hearing aid according to the third embodiment of the present invention, an auricle mold 20 is attached to the hearing aid main body 1. The auricle mold 20 is made of resin such as elastomer, silicon or a photo-curing resin. The auricle mold 20 is prepared by the same method as an ear mold, in which the shape of the rear side of the auricle is taken with an impression material, and a mold is made based on the shape. The peripheral shape is appropriately adjusted corresponding to a user.

The face shape of the auricle mold 20 to be contacted with the hearing aid main body 1 is adjusted corresponding to the hearing aid main body 1. The auricle mold 20 can be attached to the hearing aid main body 1 directly. Preferably, the auricle mold 20 is attached to the hearing aid main body 1 with a double-coated tape or an adhesive having a small adhering property so as to be easily stripped. A boss-rib structure may be provided so as to combine the auricle mold 20 and the hearing aid main body 1, or the auricle mold 20 and the hearing aid main body 1 are integrally formed. When a resin having such a property that the elasticity can be increased with temperature such as body temperature, it is possible to improve the fit.

As described above, according to the present invention, the tube or the connecting member for connecting the hearing aid main body and the earplug can be transformed into a desired shape, and the transformed shape can be maintained with a metallic member having a string shape. Consequently, by adjusting the shape of the tube or the connecting member corresponding to the shape of a user's auricle or the like, it is possible to achieve a behind-the-ear type hearing aid which can improve a fit to the user.

Although there have been described what are the present embodiments of the invention, it will be understood that variations and modifications may be made thereto within the scope of the claims appended hereto.

What is claimed is:

1. A behind-the-ear type hearing aid comprising:

a hearing aid main body; and a tube which extends from the hearing aid main body to an external auditory meatus, wherein the tube is constructed so as to be freely transformed into a desired shape when the hearing aid is worn by the user, and to maintain the desired shape after being transformed; and wherein the tube is formed of shape-memory resin which deforms by a light of a specific wavelength during irradiation thereof.

2. The behind-the-ear type hearing aid according to claim 1, wherein the hearing aid main body contacts a portion of a user's body when the hearing aid is worn by the user, and a shape of the hearing aid main body to be in contact with a user's body is formed corresponding to a shape of the portion of the user's body.

3. The behind-the-ear type hearing aid according to claim 2, further comprising an auricle mold which is molded to have a shape corresponding to a shape of portion of a user's ear, and the auricle mold is operatively connected to the hearing aid main body such that the auricle mold will contact the portion of the user's ear when the hearing aid is worn by the user.

4. The behind-the-ear type hearing aid according to claim 1, wherein the tube includes a metal wire which extends in a longitudinal direction of the tube, permits the tube to be freely manipulated to transform into the desired shape, and maintains the desired shape after being transformed.

5. The behind-the-ear type hearing aid according to claim 4, wherein the metal wire is embedded in a wall of the tube.

6. The behind-the-ear type hearing aid according to claim 1, further comprising an earphone; and an earplug provided with said earphone;

wherein the earplug provided with the earphone is disposed on a tip of the tube; and wherein the tube operatively connecting the earplug with the hearing aid main body is constructed so as to be freely transformed into the desired shape and to maintain the desired shape after being transformed.

* * * * *